US007209143B2

(12) United States Patent
Hwang

(10) Patent No.: US 7,209,143 B2
(45) Date of Patent: Apr. 24, 2007

(54) COMPUTER SYSTEM

(75) Inventor: Yong-sang Hwang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 230 days.

(21) Appl. No.: 10/956,038

(22) Filed: Oct. 4, 2004

(65) Prior Publication Data

US 2005/0128215 A1 Jun. 16, 2005

(30) Foreign Application Priority Data

Dec. 12, 2003 (KR) ..... 10-2003-0090650

(51) Int. Cl.
*G09G 5/02* (2006.01)

(52) U.S. Cl. ..... 345/589; 345/690; 349/105

(58) Field of Classification Search ..... 257/E31.123; 333/167, 172, 181, 182, 260–262; 345/589, 345/690; 349/105, 106; 361/818; 375/346; 382/264; 455/63.1, 114.2, 278.1, 296, FOR. 224
See application file for complete search history.

(56) References Cited

U.S. PATENT DOCUMENTS

| | | | | |
|---|---|---|---|---|
| 4,723,299 | A * | 2/1988 | Kobayashi | 382/315 |
| 6,784,905 | B2 * | 8/2004 | Brown et al. | 715/865 |
| 2002/0005863 | A1 * | 1/2002 | Nagai et al. | 345/698 |
| 2002/0060672 | A1 * | 5/2002 | Shin et al. | 345/204 |

FOREIGN PATENT DOCUMENTS

| | | |
|---|---|---|
| CN | 1254480 A | 5/2000 |
| JP | 2-164123 | 6/1990 |
| JP | 5-68214 | 3/1993 |
| JP | 7-111605 | 4/1995 |
| JP | 7-176964 | 7/1995 |
| KR | 1999-3705 | 1/1999 |
| KR | 1999-21377 | 6/1999 |
| KR | 1999-27732 | 7/1999 |
| KR | 20-231807 | 5/2001 |

OTHER PUBLICATIONS

Chinese Office Action dated Mar. 17, 2006.

* cited by examiner

*Primary Examiner*—Kee M. Tung
*Assistant Examiner*—G. F. Cunningham
(74) *Attorney, Agent, or Firm*—Staas & Halsey LLP

(57) ABSTRACT

A computer system including a graphic chipset generating RGB signals characterizing RGB components, and an output port through which the RGB signals are transmitted from the graphic chipset to a display device, further including an EMI filter to filter EMI from the RGB signals generated by the graphic chipset, and to transmit the filtered RGB signals to the output port; a definition improver to adjust an output level of the RGB signals generated by the graphic chipset to a predetermined output level, and to transmit the adjusted RGB signal to the output port; and a selection switch to selectively connect an output terminal of the graphic chipset with the EMI filter or the definition improver.

23 Claims, 4 Drawing Sheets

70

COMPUTER SYSTEM

CROSS-REFERENCE TO RELATED APPLICATIONS

This application claims the benefit of Korean Patent Application No. 2003-90650, filed Dec. 12, 2003, in the Korean Intellectual Property Office, the disclosure of which is incorporated herein by reference.

BACKGROUND OF THE INVENTION

1. Field of the Invention

The present invention relates to a computer system, and, more particularly, to a computer system comprising a video interface outputting red, green and blue (RGB) signals after filtering electromagnetic interference (EMI).

2. Description of the Related Art

FIG. 1 is a schematic circuit diagram of a video interface in a conventional computer system.

As shown therein, a video interface comprises a graphic chipset 100, a resistor R100, EMI filters 110*a* through 110*c*, and an output port 120.

The graphic chipset 100 is employed as an auxiliary processor to process a video signal, and comprises a digital-to-analog converter (DAC) input terminal, and RGB output terminals.

The DAC input terminal is connected with the resistor R100 having a predetermined resistance. The resistor R100 determines an output level of an RGB signal according to a specification of the graphic chipset 100.

The RGB output terminals output RGB signals characterizing RGB components, forming dots of a display device. A frequency of each RGB signal should be high to display a high-definition picture. Such high-frequency RGB signals cause EMI to be increased. Therefore, the video interface comprises the EMI filters 110*a*~110*c* to filter the EMI from the RGB signals.

Each EMI filter 110*a*~110*c* is a kind of 2π-filter constructed by combination of capacitors C10*a*~C30*c* and inductors L10*a*~L20*c*. Here, various filters such as a π-filter having a capacitor-inductor-capacitor structure, a T-filter constructed by inductor-capacitor-inductor, a C-filter constructed by only capacitor, etc., can replace the 2π-filter as the EMI filter. The EMI filters 110*a*~100*c* vary in a pass-bandwidth and a block-bandwidth corresponding to the frequency of the RGB signals. Further, the EMI filters 110*a*~100*c* have different response patterns corresponding to the frequency of the RGB signals.

The output port 120 is used in transmitting the RGB signals from the EMI filters 110*a*~100*c* to the external display device therethrough.

However, filtering the EMI from the RGB signals causes a phase and amplitude of the RGB signal generated by the graphic chipset 100 to change. Thus, a displayed picture may be decreased in picture quality such as sharpness, etc. Such a problem arises when the display device for a computer system is replaced by another compatible display device. However, in the graphic chipset 100 of the conventional computer system, the resistor R100 and the EMI filters 110*a*~110*c* are invariably connected, so that a user is not allowed to control the video interface in order to improve the picture quality. Further, it is difficult to consider both the EMI and the output level while constructing the EMI filters.

SUMMARY OF THE INVENTION

Accordingly, it is an aspect of the present invention to provide a computer system which can provide a high-definition picture controlling a video interface.

Additional aspects and/or advantages of the invention will be set forth in part in the description which follows and, in part, will be obvious from the description, or may be learned by practice of the invention.

The foregoing and/or other aspects of the present invention are achieved by providing a computer system comprising a graphic chipset generating RGB signals characterizing RGB components, and an output port through which the RGB signals are transmitted from the graphic chipset to a display device, further comprising: an EMI filter to filter EMI from the RGB signals generated by the graphic chipset, and to transmit the filtered RGB signals to the output port; a definition improver to adjust an output level of the RGB signals generated by the graphic chipset to a predetermined output level, and to transmit the adjusted RGB signal to the output port; and a selection switch to selectively connect an output terminal of the graphic chipset with the EMI filter or the definition improver.

According to an aspect of the invention, the computer system may further comprise a signal level selector to output a level control signal to adjust the output level of the RGB signal generated by the graphic chipset, and a level adjuster to adjust the output level of the RGB signal according to the level control signal.

According to an aspect of the invention, the signal level selector may comprise a plurality of adjusting resistors to be connected to the level adjuster, and a resistor selector selectively connecting one of the adjusting resistors to the level adjuster.

According to an aspect of the invention, the signal level selector may comprise a variable resistor connected to the level adjuster, and a resistor controller to control the variable resistor.

According to an aspect of the invention, the selection switch may be selected by a user according to definition of the display device.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE PREFERRED EMBODIMENTS

Figure 1:
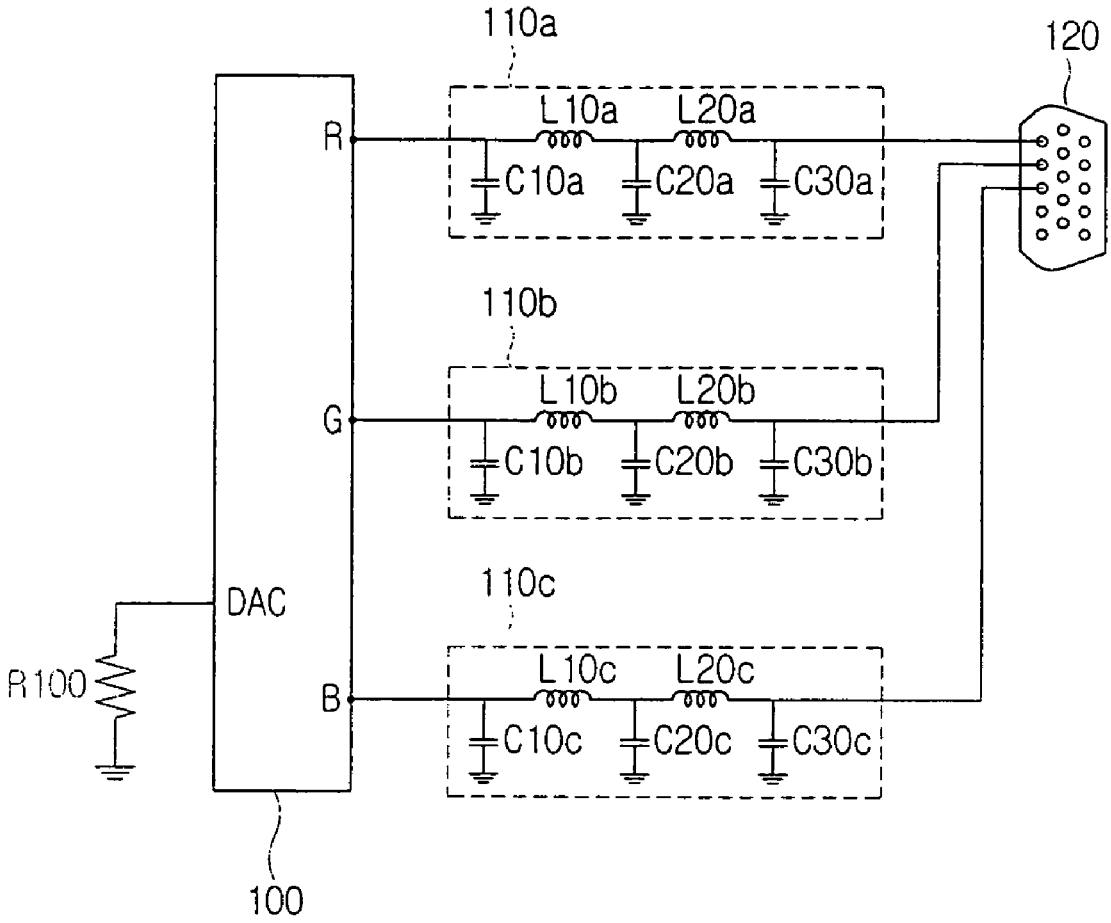
FIG. 1 (PRIOR ART)
FIG. 1 is a schematic circuit diagram of a video interface in a conventional computer system.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
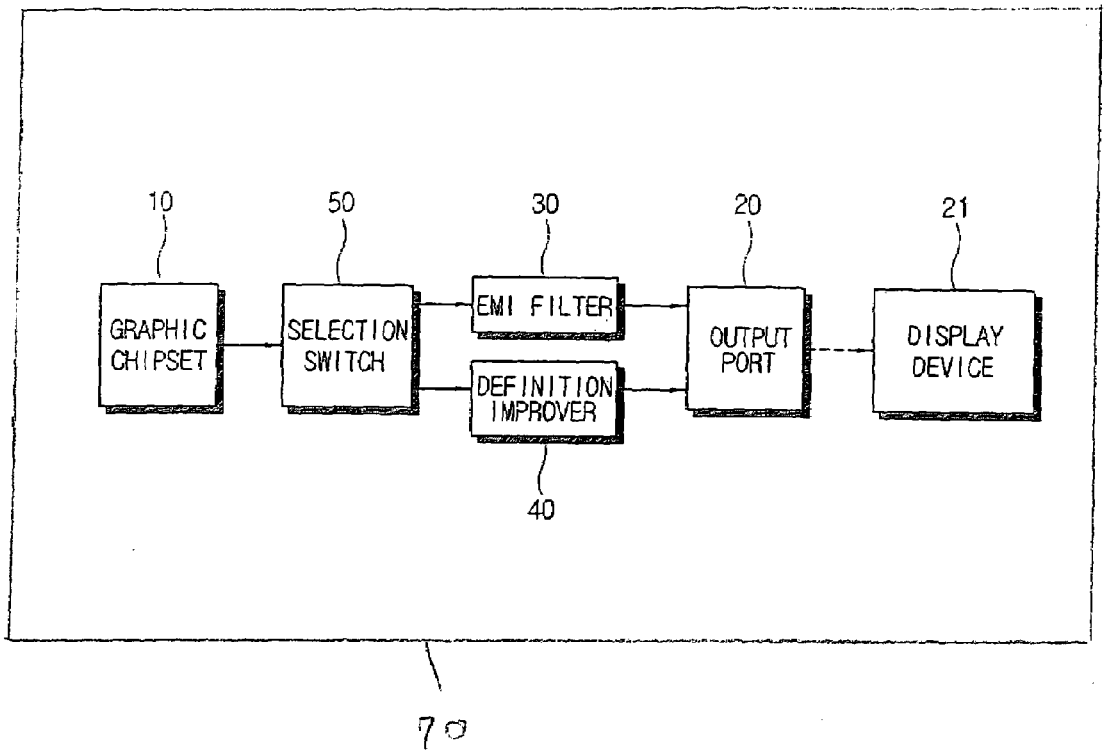
FIG. 2 is a block diagram of a computer system according to an embodiment of the present invention.

FIG. 2 is a block diagram of a computer system 70 according to an embodiment of the present invention.

As shown in FIG. 2, a computer system 70 according to this embodiment of the present invention comprises a graphic chipset 10, an output port 20, a display device 21, an EMI filter 30, a definition improver 40, and a selection switch 50.

The graphic chipset 10 generates RGB signals, characterizing RGB components, and horizontal/vertical synchronizing signals. The graphic chipset 10 is generally provided in a graphic card, but may be mounted on a main board.

The output port 20 is used in transmitting a video signal, etc., generated in the graphic chipset 10, to the display device 21. The output port 20 is divided into an analog port, such as a D-sub, and a digital port, such as a digital video interface (DVI), according to a data type. Recently, the graphic card generally comprises both the analog port and the digital port to support any video signal, regardless of the processible data type of the display device 21.

The EMI filter 30 filters the EMI from the RGB signals generated by the graphic chipset 10, thereby transmitting the RGB signals decreased in the EMI to the output port 20.

The definition improver 40 adjusts an output level of the RGB signals generated by the graphic chipset 10 so as to improve picture quality, and transmits the adjusted RGB signals to the output port 20. As compared with the EMI filter 30, the definition improver 40 comprises elements capable of minimizing distortion of the RGB signal. That is, the sharpness of a picture due to the RGB signals generated by the graphic chipset 10 is higher than that due to the RGB signals outputted from the EMI filter 30. The definition improver 40 comprises a register, etc., capable of lowering the output level of the RGB signals. Further, the definition improver 40 may also comprise an inductor to adjust impedance depending on the frequency of the specific RGB signals, and to prevent surge current.

The selection switch 50 allows an output terminal of the graphic chipset 10 to be selectively connected to one of the EMI filter 30 and the definition improver 40, thereby determining a transmitting path of the RGB signals from the graphic chipset 10 to the output port 20. The selection switch 50 comprises a switching element.

Thus, a user can check the picture quality, such as the sharpness, of the display device 21 connected to the computer system 70, and control the selection switch 50 according to a result of the check. If the sharpness of the display device 21 is not high, a user can select the output terminal of the graphic chipset 10 to be connected to the definition improver 40, thereby improving the definition.

Figure 3:
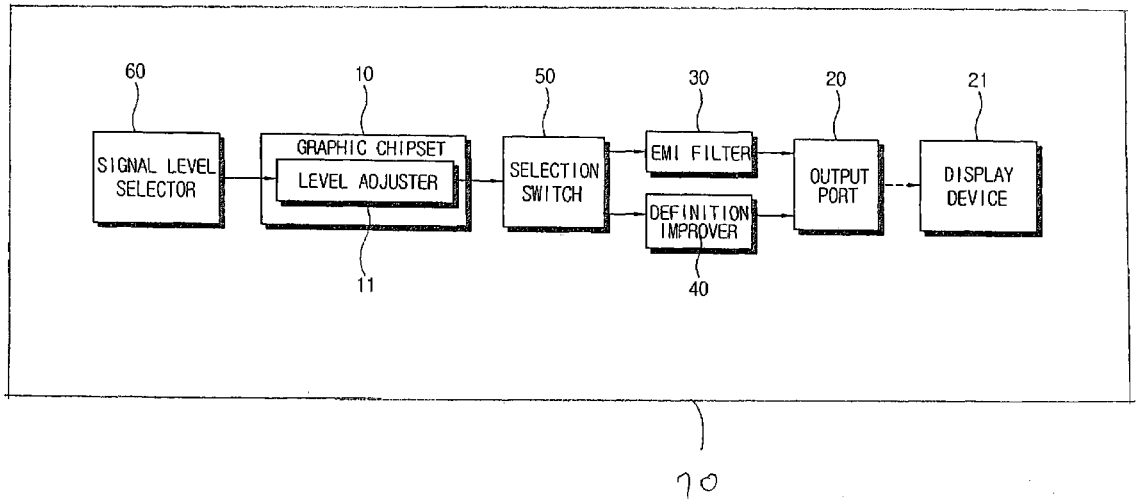
FIG. 3 is a block diagram of a computer system according to another embodiment of the present invention.

FIG. 3 is a block diagram of a computer system 70 according to another embodiment of the present invention. As shown in FIG. 3, a computer system 70 according to this embodiment of the present invention comprises a graphic chipset 10, an output port 20, a display device 21, an EMI filter 30, a definition improver 40, a selection switch 50, and a signal level selector 60.

Hereinbelow, the computer system 70 according to this embodiment will be described, centering around a configuration and a control method different from the previously discussed embodiment.

The signal level selector 60 outputs a level control signal to adjust the output level of the RGB signal generated by the graphic chipset 10. At this time, the level control signal includes an electric signal of various states to select the output level of the RGB signal.

The graphic chipset 10 comprises a level adjuster 11 to receive the level control signal from the signal level selector 60 and to adjust the output level of the RGB signal on the basis of the level control signal.

When it is difficult to obtain the best definition by selecting the selection switch 50, a user selects the signal level selector 60 to output the level control signal to the level adjuster 11. Thus, a user can make the display device 21 have the best definition by selecting the signal level selector 60.

Figure 4:
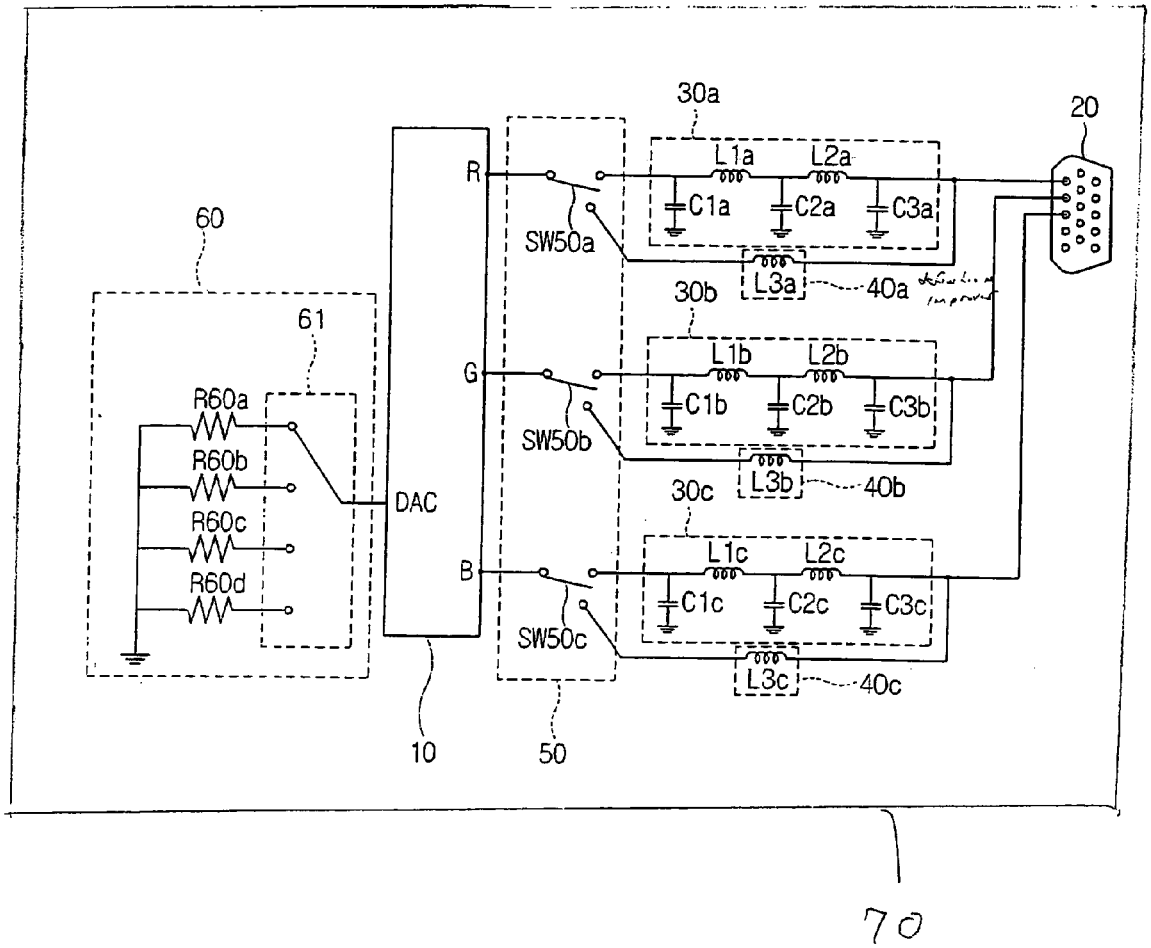
FIG. 4 is a schematic circuit diagram of a graphic card in the computer system according to the embodiment of the present invention shown in FIG. 3.

FIG. 4 is a schematic circuit diagram of a graphic card in the computer system 70 according to the embodiment of the present invention shown in FIG. 3, wherein the graphic card comprises the graphic chipset 10, the output port 20, the EMI filters 30*a*~30*c*, the definition improvers 40*a*~40*c*, and the signal level selector 60.

The graphic chipset 10 comprises output terminals R, G, and B respectively outputting RGB signals, and an input terminal DAC of the level adjuster 11. Further, the output port 20 comprises a D-sub (15 pin) through which an analog waveform signal is outputted.

Each EMI filter 30*a*~30*c* is a kind of 2π-filter constructed by combination of capacitors C1*a*~C3*c* and inductors L1*a*~L2*c*. The definition improver 40*a*~40*c* comprises the inductors L3*a*~L3*c* to prevent the surge current, respectively. The selection switch 50 comprises three switching elements SW50*a*~SW50*c* that have first ends respectively connected to the RGB output terminals R, G, and B, and second ends respectively connected to the EMI filter 30 or the definition improver 40.

The signal level selector 60 comprises a plurality of adjusting resistors R60*a*~R60*d*, and a resistor selector 61 selectively connecting one of the adjusting resistors R60~60*d* to the level adjuster 11. The adjusting resistors R60*a*~R60*d* are different from each other in resistance, and each adjusting resistor R60*a*~R60*d* has a first end connected to a ground terminal and a second end connected to the level adjuster 11. Further, the respective resistances of the adjusting resistors R60*a*~R60*d* have a predetermined variation therebetween. Further, the resistor selector 61 comprises a switching element to allow a user to select the resistors R60*a*~R60*d*.

To improve the picture quality of the display device 21, first, a user can select the selection switch 50. If the picture quality adjusted through selecting the selection switch 50 does not satisfy a user, a user can select the resistor selector 61 to allow the adjusting resistors R60*a*~R60*d* to be selectively connected to the graphic chipset 10. Then, the level adjuster 11 of the graphic chipset 10 determines the resistance of the adjusting resistor R60*a*~R60*d* connected to the input terminal thereof and adjusts the output level of the RGB signal on the basis of the determined resistance. Hence, a user can make the display device 21 have the best definition by selecting the resistor selector 61.

Preferably, though not necessarily, the respective resistances of the adjusting resistors R60*a*~R60*d* are determined in consideration of the output level of the RGB signals generated by the graphic chipset 10 and the transmitting path of the RGB signals, and have a predetermined variation. Also preferably, but again not necessarily, the plurality of the adjusting resistors R60*a*~R60*d* have respective resistances within +/−20% of a default resistance.

On the other hand, the signal level selector 60 may have a variable resistor (not shown) instead of the adjusting resistors R60*a*~R60*d*, and a resistor controller (not shown) to control the variable resistor. Here, the resistance of the variable resistor can be continuously adjustable, thereby allowing a user to select the output level of the RGB signals more finely.

As described above, the present invention provides a computer system which can provide a high-definition picture regardless of a display device and an EMI filter.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A computer system comprising a graphic chipset generating RGB signals characterizing RGB components and an output port, the system comprising:

an EMI filter to filter EMI from the RGB signals generated by the graphic chipset, and to transmit the filtered RGB signals to the output port if selected by a selection switch;

a definition improver to adjust an output level of the RGB signals generated by the graphic chipset to a predetermined output level, and to transmit the adjusted RGB signals to the output port if selected by the selection switch; and the selection switch to selectively connect an output terminal having the RGB signals generated by the graphic chipset with the EMI filter or the definition improver.

2. The computer system according to claim 1, further comprising:

a signal level selector to output a level control signal to adjust the output level of the RGB signal generated by the graphic chipset; and a level adjuster to adjust the output level of the RGB signal according to the level control signal.

3. The computer system according to claim 2, wherein the level adjuster is provided as part of the graphic chipset.

4. The computer system according to claim 2, wherein the signal level selector comprises a plurality of adjusting resistors to be connected to the level adjuster, and a resistor selector selectively connecting one of the adjusting resistors to the level adjuster.

5. The computer system according to claim 4, wherein each of the plurality of adjusting resistors has a different resistance value, a first end connected to a ground, and a second end connected to the level adjustor.

6. The computer system according to claim 5, wherein the different resistance values of the adjusting resistors have a predetermined variation therebetween.

7. The computer system according to claim 6, wherein the different resistance values of the adjusting resistors are determined according to the output level of the RGB signals generated by the graphic chipset and a transmitting path of the RGB signals.

8. The computer system according to claim 6, wherein the different resistance values of the adjusting resistors are within +/−20% of a default resistance.

9. The computer system according to claim 2, wherein the signal level selector comprises a variable resistor connected to the level adjuster, and a resistor controller to control the variable resistor.

10. The computer system according to claim 1, wherein the selection switch is selected by a user according to definition of the display device.

11. The computer system according to claim 2, wherein the selection switch is selected by a user according to definition of the display device.

12. The computer system according to claim 1, wherein the graphic chipset is provided in a graphic card.

13. The computer system according to claim 1, wherein the graphic chipset is provided on a main board.

14. The computer system according to claim 1, wherein the definition improver comprises a register to lower the output level of the RGB signals.

15. The computer system according to claim 1, wherein the definition improver comprises at least one inductor to adjust impedance according to a frequency of the RGB signals, and to prevent surge current.

16. The computer system according to claim 1, wherein the selection switch comprises at least one switching element having a first end connected to the graphic chipset and a second end connected to the EMI filter or the definition improver.

17. A computer system for enhancing image quality in a graphic signal for a display, the system comprising:

a graphic signal generator to generate a graphic signal;

a definition improver to adjust an output level of the graphic signal generated by the graphic signal generator to a predetermined output level:

a filter to filter the graphic signal generated by the graphic signal generator; and a selector to selectively output one of the output level adjusted graphic signal and the filtered graphic signal to an output port for transmission to the display.

18. The computer system according to claim 17, further comprising a level adjuster to adjust the magnitude of the graphic signal generated by the graphic signal generator.

19. The computer system according to claim 17, further comprising an output part to transmit the output signal from the selector to an external device.

20. The computer system according to claim 17, wherein the filter filters EMI of the graphic signal.

21. The computer system according to claim 17, wherein the graphic signal generator comprises a graphic chipset.

22. The computer system according to claim 18, wherein the graphic signal generator comprises a graphic chipset, and the level adjuster comprises:

a plurality of adjusting resistances to adjust an output level of the graphic chipset; and a switch to selectively connect the graphic chipset to one of the plurality of adjusting resistances.

23. The computer system according to claim 19, wherein the selector comprises a switch to selectively connect the output part to one of the graphic signal generator and the filter.

* * * * *

UNITED STATES PATENT AND TRADEMARK OFFICE

CERTIFICATE OF CORRECTION

PATENT NO. : 7,209,143 B2
APPLICATION NO. : 10/956038
DATED : April 24, 2007
INVENTOR(S) : Yong-sang Hwang It is certified that error appears in the above-identified patent and that said Letters Patent is hereby corrected as shown below:

Column 6, Line 28, change “level:” to --level;--.

Signed and Sealed this

Seventh Day of August, 2007

JON W. DUDAS
*Director of the United States Patent and Trademark Office*